US005447459A

United States Patent [19]

Hammond

[11] Patent Number: 5,447,459

[45] Date of Patent: Sep. 5, 1995

[54] UNDERWATER VIEWING BOARD

[75] Inventor: Norman R. Hammond, La Jolla, Calif.

[73] Assignee: VU Boards International, La Jolla, Calif.

[21] Appl. No.: 188,810

[22] Filed: Jan. 31, 1994

[51] Int. Cl.[6] ..... B63B 35/00

[52] U.S. Cl. ..... 441/135; 441/65; 114/66

[58] Field of Search ..... 441/1, 65, 135; 114/66, 114/357

[56] References Cited

U.S. PATENT DOCUMENTS

| | | | |
|---|---|---|---|
| 1,258,324 | 3/1918 | Egenes . | |
| 1,810,302 | 6/1931 | Stiles . | |
| 2,343,473 | 3/1944 | Pierson . | |
| 2,404,556 | 7/1946 | Wirth . | |
| 2,712,139 | 7/1955 | Kelly . | |
| 2,717,399 | 9/1955 | Backhouse . | |
| 2,730,921 | 1/1956 | Little . | |
| 2,746,194 | 5/1956 | Lonnman . | |
| 2,911,878 | 11/1959 | Vernier . | |
| 3,081,726 | 3/1963 | Betts et al. | 441/135 |
| 3,384,910 | 5/1968 | Heston, Jr. et al. | 441/65 |
| 4,145,783 | 3/1979 | Rhodes | 114/66 X |
| 4,228,751 | 10/1980 | Robertson et al. | 441/135 X |
| 4,548,148 | 10/1985 | Bloomfield, III | 114/66 |
| 4,691,658 | 9/1987 | New et al. | 441/135 X |
| 4,895,539 | 1/1990 | Bender | 114/66 |
| 4,925,417 | 5/1990 | Warren | 441/135 X |

FOREIGN PATENT DOCUMENTS

| | | |
|---|---|---|
| 0883317 | 7/1943 | France . |
| 1254432 | 5/1961 | France . |
| 2537436 | 1/1977 | Germany . |
| 0221991 | 9/1987 | Japan . |

OTHER PUBLICATIONS

Dry Diver International, Inc. Product Advertisement—2 Pages.

*Primary Examiner*—Sherman Basinger
*Attorney, Agent, or Firm*—Brown, Martin, Haller & McClain

[57] ABSTRACT

A buoyant board for viewing underwater objects while an observer is lying in a prone position is of seamless, unitary construction, and has a viewing well extending through the body of the board that is integrally formed with the body. The body may be formed of rotomolded plastic. The board may have a vent to relieve excessive air pressure within the board, but is otherwise sealed so as to be substantially watertight. The board may also have a drain plug or valve that allows water that accumulates in the interior of the board as a result of condensation or leakage to be expelled. The upper end of the viewing well has a contoured shape that conforms generally to the contours of the human face. A transparent window is mounted at the lower end of the viewing well and may be recessed from the bottom of the board or mounted flush with the bottom of the board by providing a countersunk edge around the periphery of the lower end of the well.

36 Claims, 2 Drawing Sheets

UNDERWATER VIEWING BOARD

BACKGROUND OF THE INVENTION

The present invention relates generally to devices for facilitating the observation of underwater objects by a person above the water and, more specifically, to such a device that supports the person's body in a prone position while observing.

Glare or light reflecting off the surface of a body of water prevents effective viewing of underwater objects from a position above the water. Viewing tubes or boxes, which have an opening near the observer's face and a transparent window below the surface of the water, have long been used to overcome the problem of glare. Examples of such devices are shown in U.S. Pat. No. 2,343,473, issued to Pierson, U.S. Pat. No. 2,730,921, issued to Little, U.S. Pat. No. 2,911,878, issued to Vernier, and German Patent No. 2537436. Ideally, such devices would block all light except that which is reflected from underwater objects from reaching the observer's eyes.

Practitioners in the art have included underwater viewing tubes in buoyant rafts or boards to enable a person to look underwater while lying in a prone position. Such devices have a viewing tube extending through the board that is closed at the lower end with a watertight transparent window. U.S. Pat. No. 2,717,399, issued to Backhouse, U.S. Pat. No. 3,081,726, issued to Betts et al., U.S. Pat. No. 4,691,658, issued to New et al., French No. 883,317, issued to LePrieur, French No. 1,254,432, issued to Dudouyt, and Japanese No. 62-221991, disclose examples of such devices.

Underwater viewing boards known in the art are uneconomical to manufacture. The viewing tube commonly includes four sidewalls that are fastened together. Sealant may be used to prevent water form leaking into the tube. Underwater viewing boards known in the art also allow stray light to leak into the tube between the observer's face and the edges of the tube. Moreover, it is often uncomfortable for an observer to maintain his face in contact with the ends of such tubes. These problems and deficiencies are clearly felt in the art and are solved by the present invention in the manner described below.

SUMMARY OF THE INVENTION

The present invention comprises a buoyant board for viewing underwater objects while an observer is lying in a prone position. The board is of substantially unitary construction and has a viewing well extending through the body of the board that is integrally formed in the body of the board. In an exemplary embodiment, the body is formed of rotary molded plastic. As known in the art, the process of rotary molding (often shortened to "rotomolding") heats and spins a mold containing a plastic material to produce a plastic structure with one or more interior cavities. Lightweight, hollow, seamless structures can thus be economically produced. The board of the present invention has a hollow interior with a seamless viewing well extending through the board. The board may also have one or more interior longitudinal ribs that provide strength.

The board may have a vent to relieve excessive air pressure within the interior of the board. Pressure within the board increases when the temperature of the air inside the board increases, such as when the board is exposed to the sun for prolonged periods on a hot day.

Pressure within the board also increases when the upper and lower sides of the board, which may be somewhat resilient, are squeezed together, such as when a heavy person steps or jumps on the board. Excessive pressure within the board can stress the board and damage it. The vent may include a means for preventing water from entering the interior of the board.

The board may also have a drain plug or valve. Water vapor inside the board may condense and collect inside the board. Water may also enter via the vent. The drain plug allows this water to be removed from the interior of the board to maintain buoyancy. With the exception of a vent or a drain, the interior of the board is completely sealed.

The upper end of the viewing well has a contoured shape that conforms generally to the contours of the human face. An observer lying on the board can thus place his face securely against the end of the viewing well to minimize entry of stray light. The contoured upper end of the viewing well is comfortable for extended viewing periods and may include padding or a gasket, such as that used in underwater face masks, around its perimeter.

A transparent window is mounted at the lower end of the viewing well. The window may be recessed from the bottom of the board or mounted flush with the bottom of the board by providing a countersunk edge around the perimeter of the lower end of the wall. The window is preferably mounted using a plurality of fasteners with a gasket between the window and the board for improving resistance to leakage.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
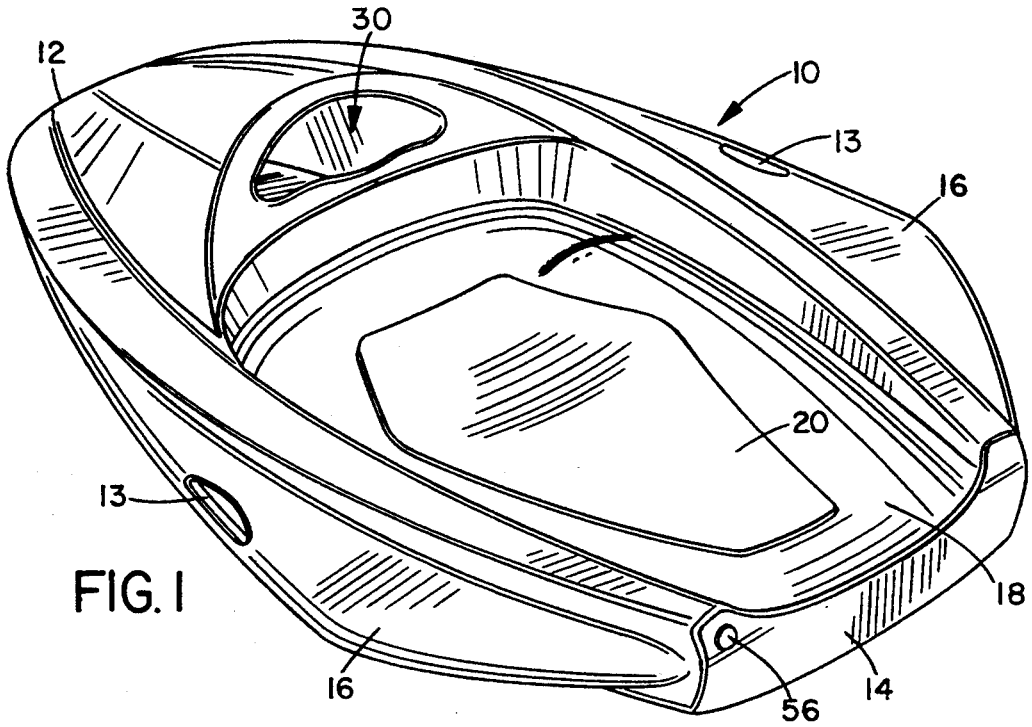
FIG. 1 is a perspective view of the board.

As illustrated in FIG. 1, the present invention is a board that comprises a substantially planar, hollow body 10 having seamless, unitary construction. Air in the hollow interior of body 10 provides buoyancy to support an observer (not shown) on the surface of a body of water (not shown).

Body 10 is formed of rotomolded medium-density polyethylene. Body 10 is wider toward its midpoint than at its forward end 12 and its aft end 14. Body 10 preferably has a maximum beam or width equal to approximately 80 percent of its length. Body 10 has wings 16 slightly aft of its midportion, which give the board a generally diamond-shaped or sting-ray shaped appearance. The wider midportion provides stability, while the narrower fore and aft portions improve hydrodynamic efficiency to enable the observer to more easily propel the board through the water. Body 10 may have handgrips 13 at the outboard end of wings 16 to facilitate carrying the board to and from the water.

A person desiring to observe an underwater scene mounts the board by lying in a prone position with the observer's face toward forward end 12. The center of body 10 preferably has a recess of scoop 18 that is parallel to the plane of the board and cradles the observer's body. Scoop 18 is shallow and rounded at its edges, giving it an almost spoon-like shape. The scoop shape prevents the observer from inadvertently rolling off the board but allows the observer to quickly and easily do so if desired. Scoop 18 also resists collection of water because the observer's body squeezes water out when the observer lies on the board. A pad 20, which is preferably made of NEOPRENE®, may be mounted on scoop 18 to increase friction between the observer's body and the board.

Figure 2:
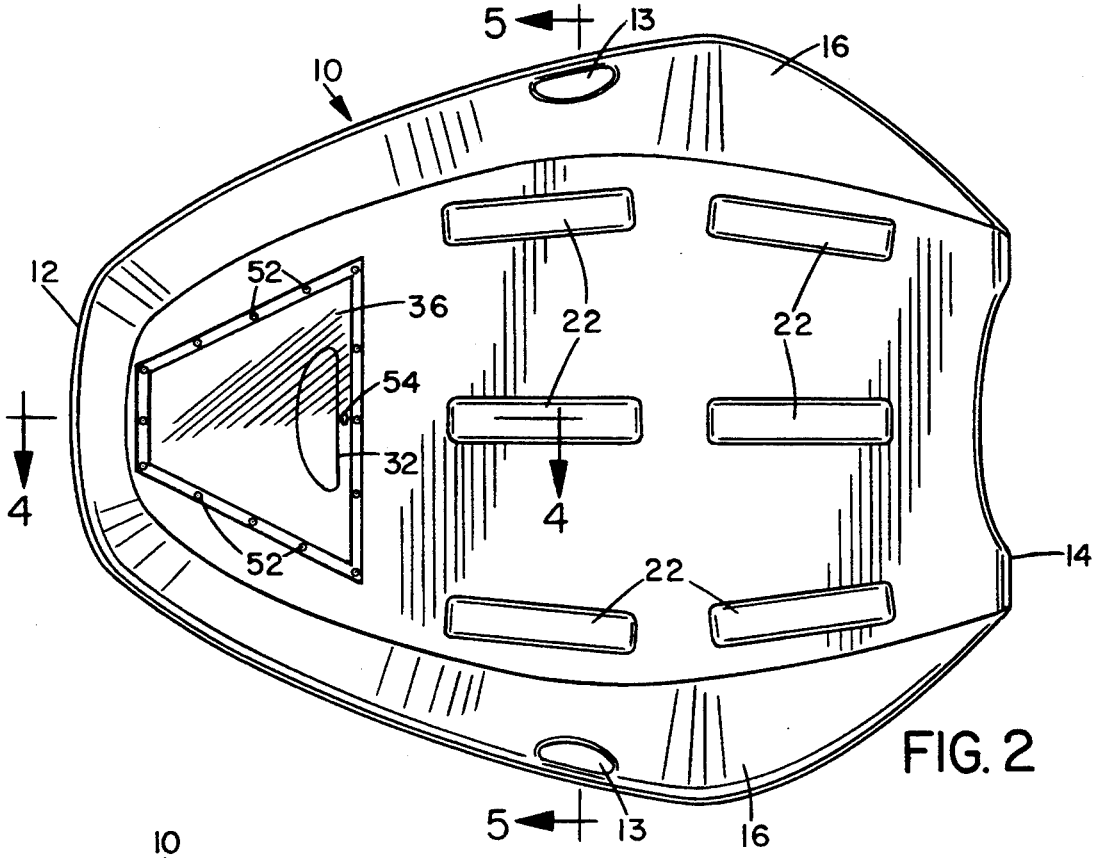
FIG. 2 is a bottom plan view of the board.
Figure 3:
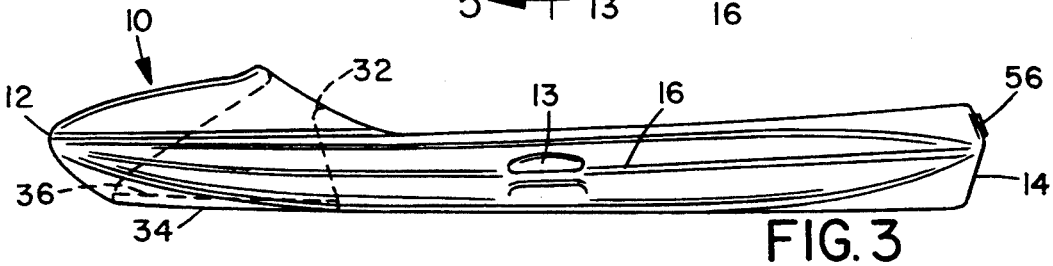
FIG. 3 is a side elevation view of the board.
Figure 4:
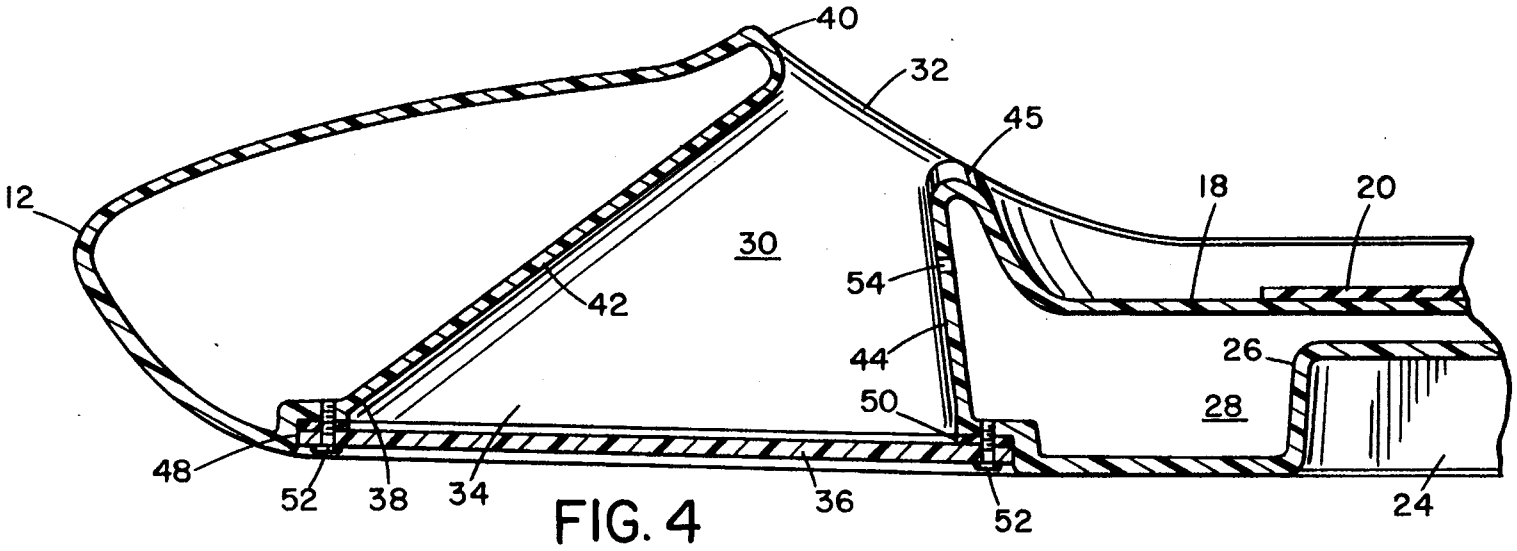
FIG. 4 is an enlarged sectional view taken along line 4—4 of FIG. 2.
Figure 5:
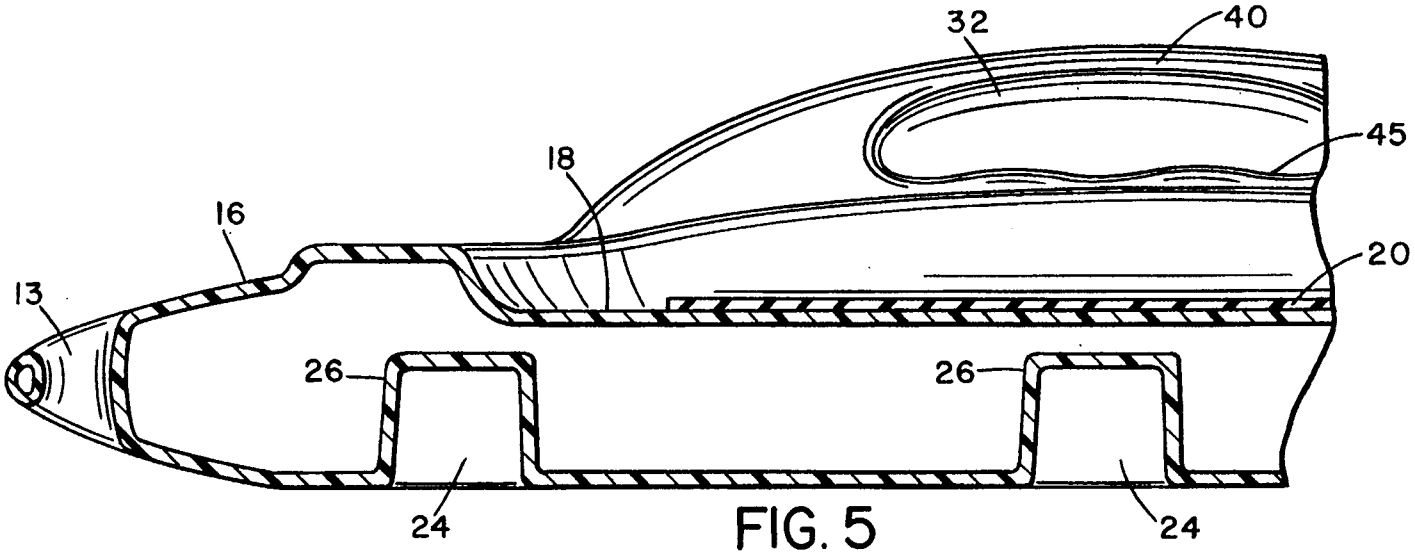
FIG. 5 is an enlarged sectional view taken along line 5—5 of FIG. 2.

The lower side of body 10, shown in FIG. 2, has six longitudinal ribs 22 integrally formed in it. Ribs 22, shown in cross-section in FIG. 5, form recesses 24 on the outside surface of body 10 and corresponding protuberances 26 that extend into the interior 28 of body 10. Ribs 22 provide strength to body 10 by resisting longitudinal flexure. Ribs 22 also prevent damage to the board because protuberances 26 contact the inside surface of the upper side of body 10 if the upper and lower sides of body 10 are forced together, such as when a heavy person steps on the board.

Body 10 has a seamless viewing well 30 integrally formed with it near forward end 12. Viewing well 30 has an upper end 32 at the upper side of body 10 and a lower end 34 at the lower side of body 10. Upper end 32 is contoured to conform generally to the contours of the human face. The observer's face can thus be placed directly against upper end 32. In this position, the amount of stray light entering between the edges of well 30 and the observer's face is minimized. A transparent window 36, which is made of a strong, scratch-resistant material such at LEXAN®, is mounted at lower end 34.

Viewing well 30 has a rounded, generally trapezoidal cross-section that increases in area from upper end 32 to lower end 34. The increasing cross-section prevents well 30 from amplifying any stray light that may enter it. The increasing cross-section also provides a panoramic view of the underwater scene beneath the board. The panoramic view extends slightly forward of the board because the forward portion 38 of lower end 34 extends forward of the forward portion 40 of upper end 32. Preferably, the forward wall 42 of viewing well 30 is oriented at an angle between approximately 30 and 40 degrees with respect to the plane in which window 36 lies. The rearward wall 44 of viewing well 30 may be oriented at a slight angle with respect to window 36, but the rearward portion 45 of upper end 32 is otherwise aligned with the rearward portion 46 of lower end 34 in a direction perpendicular to window 36.

Window 36 has a trapezoidal shape and may be mounted in a recess 48 that extends around the periphery of lower end 34 of viewing well 30. Window 36 has a thickness that is less than or equal to the depth of recess 48 and is thus recessed or countersunk into the lower side of body 10. A gasket 50 may be disposed between window 36 and lower end 34 to resist leakage of water into viewing well 30. Window 36 may be secured to body 10 with a plurality of screws 52 made of a corrosion-resistant material such as stainless steel.

Body 10 may have a vent 54 for releasing excessive air pressure in interior 28 of body 10. For example, when temperatures increase, the air trapped in body 10 expands and, unless released, could stress body 10 to the point of damaging it. In addition, if a person jumps on the board the upper and lower sides may be squeezed together, resulting in an increase in air pressure in interior 28 that, unless released, could stress body 10 to the point of damaging it. Vent 54 may be a small orifice that is preferably disposed inside well 30 to inhibit entry to water into interior 28 through vent 54.

Water may accumulate undesirably in interior 28 as a result of condensation or leakage. Body 10 may have a drain, which may comprise a plug 56 that fits into an opening in body 10, for removing such water.

In summary, the hollow, unitary construction of body 10 provides buoyancy and strength to the board and is economical to produce using a rotomolding process. The sting-ray shape of the board provides a stable platform on the water from which to view an underwater scene. The trapezoidal cross-sectional shape of viewing well 30 maximizes the viewing area, and the tapering of this cross-section reduces light amplification and provides a panoramic field of view. The contoured upper end 32 of viewing well 30 fits securely against an observer's face to reduce stray light and provide comfort for extended viewing periods.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A underwater viewing board, comprising:

a buoyant, substantially planar body having an upper side, a lower side, a forward end, an aft end, and a midportion between said forward and aft ends wider than said forward and aft ends, said body having a width and a length, said width at said midportion being at least about 80 percent as great as said length, said body being of unitary and seamless construction and having a hollow, substantially watertight interior providing primary buoyancy for said body, said body having a seamless viewing well extending therethrough and formed unitarily with the remainder of said body, said viewing well having an upper end at said upper side of said body and a lower end at said lower side of said body; and a transparent window mounted on said body at said lower end of said viewing well substantially parallel to said body.

2. The underwater viewing board of claim 1, wherein said upper end of said viewing well is contoured to conform generally to the contours of a human face.

3. The underwater viewing board of claim 1, wherein said body is made of plastic.

4. The underwater viewing board of claim 3, wherein said plastic is medium density polyethylene.

5. The underwater viewing board of claim 4, wherein said body is rotomolded.

6. The underwater viewing board of claim 1, wherein said viewing well has a generally trapezoidal cross-section.

7. The underwater viewing board of claim 6, wherein said cross-section increases in area from said upper end of said viewing well to said lower end of said viewing well.

8. The underwater viewing board of claim 7, wherein said upper and lower ends of said viewing well have forward and aft portions, and said forward portion of said lower end of said viewing well is forward of said forward portion of said upper end of said viewing well.

9. The underwater viewing board of claim 8, wherein said aft portion of said lower end of said viewing well is substantially aligned with said aft portion of said upper end of said viewing well in a direction perpendicular to said window.

10. The underwater viewing board of claim 9, wherein said window has a trapezoidal shape.

11. The underwater viewing board of claim 1, wherein said body has a recess around the periphery of said lower end of said viewing well for mounting said window therein, and said window has a thickness less than or equal to the depth of said recess.

12. The underwater viewing board of claim 11, further comprising a gasket in said recess between said window and said body.

13. The underwater viewing board of claim 1, further comprising a plurality of fasteners distributed around the perimeter of said window for mounting said window on said body.

14. The underwater viewing board of claim 13, wherein said fasteners are screws.

15. The underwater viewing board of claim 1, wherein said body is generally sting-ray-shaped.

16. The underwater viewing board of claim 15, wherein said body has at least one handle at said midportion.

17. The underwater viewing board of claim 16, wherein said body has two handles, each at an outboard portion of said midportion.

18. The underwater viewing board of claim 17, wherein said upper end of said viewing well is above the remainder of said body.

19. The underwater viewing board of claim 18, wherein said body has a scooped portion aft of said upper end of said viewing well.

20. The underwater viewing board of claim 1, wherein said body has a drain.

21. The underwater viewing board of claim 20, further comprising a removable plug, wherein said drain is an opening into which said plug fits.

22. The underwater viewing board of claim 1, wherein said body has a vent.

23. The underwater viewing board of claim 22, wherein said vent is an orifice disposed in said viewing well.

24. The underwater viewing board of claim 1, wherein said body has at least one rib.

25. The underwater viewing board of claim 24, wherein said rib is integrally formed in said lower side of said body and extends into said hollow interior.

26. The underwater viewing board of claim 25, wherein said rib forms a recess in said lower side of said body where it extends into said hollow interior.

27. The underwater viewing board of claim 1, wherein said body has six said ribs.

28. A underwater viewing board, comprising:

a buoyant, substantially planar body having an upper side, a lower side, a forward end and an aft end, said body being of unitary and seamless construction and having a hollow, substantially watertight interior, said body having a seamless viewing well extending therethrough and formed unitarily with the remainder of said body, said viewing well having an upper end at said upper side of said body and a lower end at said lower side of said body;

a transparent window mounted at said lower end of said viewing well, said window having a trapezoidal shape;

said body having a small orifice for pneumatic communication between said interior and the atmosphere and for inhibiting entry of water into said interior, said interior being sealed with respect to said atmosphere except for said orifice;

said upper and lower ends of said viewing well each having forward and aft portions, said forward portion of said lower end being forward of said forward portion of said upper end, and said aft portions of said upper and lower ends being generally aligned with each other in a direction perpendicular to said window; and said upper end of said viewing well having contours conforming generally to the contours of a human face.

29. A board, comprising:

a buoyant, substantially planar body having an upper side, a lower side, a forward end, an aft end, and a midportion between said forward and aft ends wider than said forward and aft ends, said body being generally sting-ray shaped, said body being of unitary construction and having a hollow interior; and said body having a small orifice disposed in a viewing well for pneumatic communication between said interior and the atmosphere and for inhibiting entry of water into said interior, said interior being sealed with respect to said atmosphere except for said orifice.

30. The board of claim 29, wherein said body has a drain for expelling water from said interior.

31. The board of claim 29, wherein said body is made of rotomolded plastic.

32. The board of claim 29, wherein said body has at least one rib extending into said hollow interior.

33. The board of claim 32, wherein said rib forms a recess in said lower side of said body where said rib extends into said hollow interior.

34. The underwater viewing board of claim 1, wherein said interior is devoid of buoyant material other than air.

35. The underwater viewing board of claim 28, wherein said interior is devoid of buoyant material other than air.

36. The underwater viewing board of claim 29, wherein said interior is devoid of buoyant material other than air.

* * * * *